United States Patent [19]

Aframian

[11] Patent Number: 4,896,004

[45] Date of Patent: Jan. 23, 1990

[54] LOW-PROFILE RANGE CONTROL SWITCH

[75] Inventor: Mousa Aframian, Mansfield, Ohio

[73] Assignee: White Consolidated Industries, Inc., Mansfield, Ohio

[21] Appl. No.: 240,098

[22] Filed: Sep. 2, 1988

Related U.S. Application Data

[63] Continuation-in-part of Ser. No. 107,333, Oct. 9, 1987, abandoned.

[51] Int. Cl.[4] ..... H01H 19/08; H01H 21/17

[52] U.S. Cl. ..... 200/6 B; 200/283

[58] Field of Search ..... 200/1 R, 1 A, 1 V, 6 R, 200/6 B, 6 BA, 6 BB, 6 C, 38 R, 38 FA, 38 B, 283, 284; 219/452, 507; 337/64, 327, 329, 362, 363, 380, 381

[56] References Cited

U.S. PATENT DOCUMENTS

| | | | |
|---|---|---|---|
| 3,727,015 | 4/1973 | Voland et al. | 200/38 R |
| 4,160,885 | 7/1979 | Ellicott et al. | 200/1 R |
| 4,431,907 | 2/1984 | Barnett | 219/452 X |
| 4,471,338 | 9/1984 | Holtkamp | 337/64 |
| 4,526,332 | 7/1985 | Bales | 200/38 FA |
| 4,543,456 | 9/1985 | Iwata et al. | 200/61.54 |
| 4,667,066 | 5/1987 | Ando et al. | 200/6 R X |

*Primary Examiner*—J. R. Scott

*Attorney, Agent, or Firm*—Pearne, Gordon, McCoy & Granger

[57] ABSTRACT

An infinitely adjustable control switch for controlling electric heaters in a domestic cooking range is disclosed. The control suited provides a boxlike housing which encloses two power switches and a switch for an indicator light. All of the switch components are supported by terminals positioned in a row along one side wall of the housing. Therefore, a unitary multiconductor can be used to simultaneously connect and disconnect all of the terminals. The terminals are installed in grooves formed in the side wall of the housing by lateral straight-end movement through lateral openings and without any movement lengthwise of the terminals. The terminals are then staked and a locking bar is installed to complete the mounting of the terminals and the switch components. Some of the terminals are provided with extension to support switch components at remote locations. Further the housing is provided with projections which position such extensions. The housing is provided with an inclined rearward wall portion to reduce the housing thickness along one edge and to allow the control suited to be mounted in shallow switch recesses having a depth which varies from one location to another.

9 Claims, 7 Drawing Sheets

LOW-PROFILE RANGE CONTROL SWITCH

BACKGROUND OF THE INVENTION

This application is a continuation-in-part of copending application Ser. No. 07/107,333, filed Oct. 9, 1987, now abandoned.

This invention relates generally to control switches, and more particularly to a novel and improved, infinitely variable thermal cycling control switch. Such switch is particularly suited for regulating the heat output of a surface unit of a domestic electric cooking range.

PRIOR ART

Domestic electric cooking ranges include a cooking platform or surface in which a plurality (usually four) of resistance surface cooking units are provided. Each surface cooking unit is provided with a control switch permitting the user to individually control the associated unit.

Typically, the control switches are mounted on vertically extending control panels at either the front or the back edge of the cooking surface. Such switches provide a user-accessible control knob which is adjusted by the user to adjust the heat output of the associated cooking unit. When such switches are infinitely variable, they normally provide a bimetal leg supporting one of the switch contacts of one of the switches. The bimetal leg is connected in series with the associated cooking unit, and operates to open and close the switch with a time cycle determined by the position of the other contact of the switch. The position of such other contact of the switch is controlled by a cam connected to the control knob.

An example of such a control switch is described and claimed in U.S. Letters Pat. No. 4,471,338 (assigned to the assignee of the present invention), and such patent is incorporated herein by reference in its entirety.

In the past, the switch components have usually been mounted on an associated terminal which is in turn mounted on the rearward wall of the switch housing. Generally, such terminals are positioned in the rear wall of the housing at locations selected for convenient support of the associated switch component. Consequently, the terminals have been located in essentially a random pattern. Therefore, such terminals have usually been connected by an individual connector associated with each terminal.

The labor involved in connecting individual connectors to individual terminals is significantly greater than would be required if a single compound terminal connector were utilized to connect all of the terminals. Further, the use of separate and individual connectors increases the likelihood of incorrect wiring of the switch into the range system. Further, since the terminals usually project from the rearward or back face of the switch housing, a relatively deep cavity has been required for each switch.

SUMMARY OF THE INVENTION

There are several aspects to the present invention. In accordance with one important aspect of this invention, the terminals of the range control switch are arranged in a row and extending parallel to each other. A unitary multiconductor connector is provided with a separate conductor for each terminal and is installable as a unit to provide all of the switch connections. Such unitary connector facilitates automated assembly and, even when manually installed, reduces the labor content required for the installation and eliminates the possibility of incorrect wiring.

In accordance with another aspect of this invention, the row of terminals is provided in a side wall of the switch housing rather than in the rearward wall thereof. Therefore, the depth of the cavity required to mount the control switch is substantially reduced and approaches the depth of the switch housing itself.

In accordance with still another aspect of this invention, a novel and improved structure is provided to allow installation of the switch terminals in a side wall of the switch housing without requiring longitudinal movement of the terminals with respect to their length. Further, a novel and improved structure is provided for securing the terminals of a control switch in the switch housing thereof.

In accordance with the illustrated embodiment of this invention, the switch housing is provided with a stepped side wall within which the switch terminals are mounted. Such stepped side wall provides mounting grooves and laterally extending slots or openings, permitting the terminals of the switch to be moved into their mounted position by passing through the associated slot or opening. When each of the terminals is positioned in its mounting groove, it is staked on one side and subsequently a locking bar is installed against the opposite side of the terminal to permanently secure the terminal within the housing.

The illustrated control switch provides two line switches and a pilot light switch. Each switch provides switch arms extending generally parallel to the rearward wall of the switch housing. The terminals are shaped to support each of the switch arms in its proper location within the housing, even though the terminals are all mounted along one side wall of the housing.

In order to permit the installation of the switch within a shallow range cavity, the rearward wall of the illustrated embodiment of the housing is provided with an inclined portion so that the depth of the switch housing adjacent the one edge is less than the depth adjacent to the opposite edge.

Since all of the terminals are positioned in alignment, the illustrated control switch is connected to the circuitry of the associated range by a unitary connector providing a conductor associated with each terminal. Such unitary connector can only be installed in a correct position. This ensures that the proper electrical connections are provided and facilitates the automated assembly of the unit.

According to another embodiment of the present invention, the stepped wall portion is partially open or cut away. This provides easier access during assembly so that the terminals can be moved a slight distance laterally and the length of the slots or lateral openings can be shortened for increased rigidity. This also provides better access for a supporting tool during assembly. The cutaway portion is covered by a projecting lip or ledge on the locking bar which also gives greater rigidity to that member.

These and other aspects of the present invention are illustrated in the accompanying drawings, and are more fully described in the following specification.

DETAILED DESCRIPTION OF THE DRAWINGS

Figure 1:
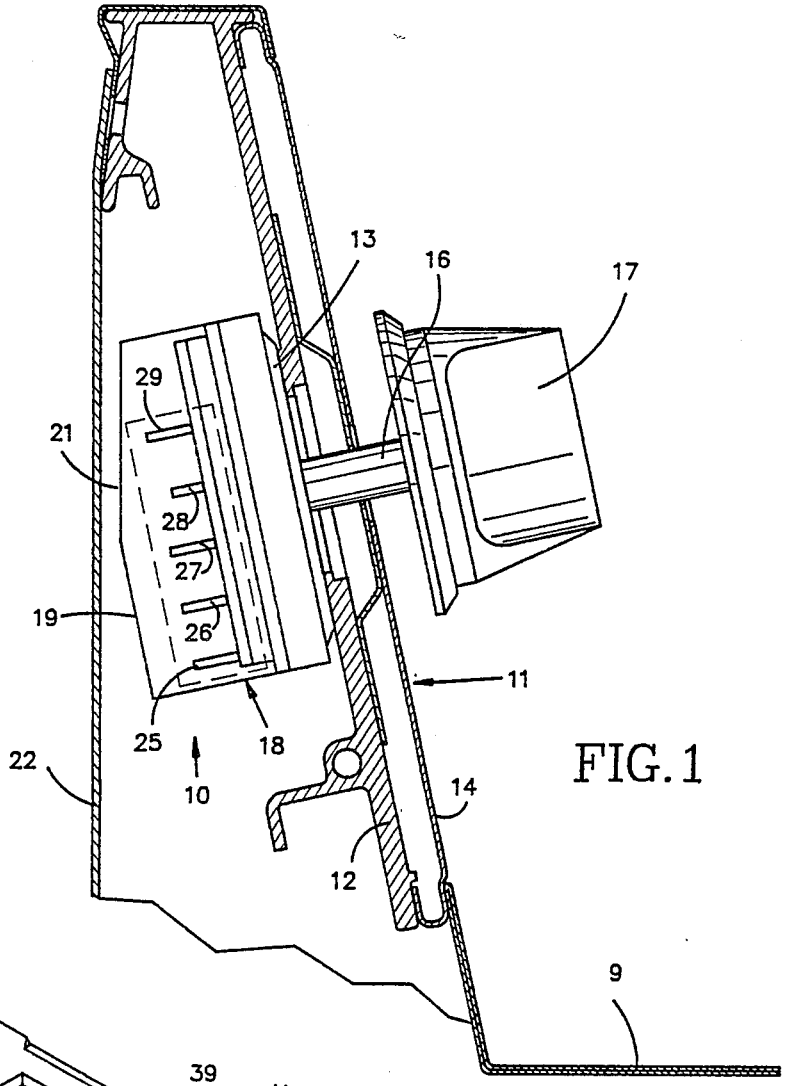
FIG. 1 is a schematic side elevation of a preferred embodiment of this invention installed in a typical domestic cooking range.

FIG. 1 illustrates the mounting of a control switch 10 in accordance with the present invention within a typical control panel 11 of the domestic cooking range. The illustrated control panel 11 is provided at the rearward edge of the cooking platform 9 and extends upwardly therefrom at an angle. Normally, in such control panel 11, a control switch is provided for each of the surface units and for the oven or ovens if they are provided. The illustrated control panel includes an inclined frame member 12 against which a cover 13 of the control switch 10 is secured by screws or the like (not illustrated). Forwardly of the frame member is a trim panel 14 through which a control shaft 16 of the switch 10 projects. A user control knob 17 is mounted on the end of the control shaft.

In the illustrated embodiment, the control switch 10 is provided with a housing 18 having a rearward surface providing a first rearward surface portion 19 parallel to the face of the cover 13 and an inclined wall portion 21 inclined forwardly from the rearward surface portion 19 at an angle substantially equal to the angle of inclination of the frame member 12. Therefore, the inclined wall portion 21 in the illustrated embodiment extends in a vertical direction and is substantially parallel to a rearward trim panel 22. By providing this inclined wall portion 21, it is possible to mount the control switch 10 within a very narrow control panel 11.

Figure 2:
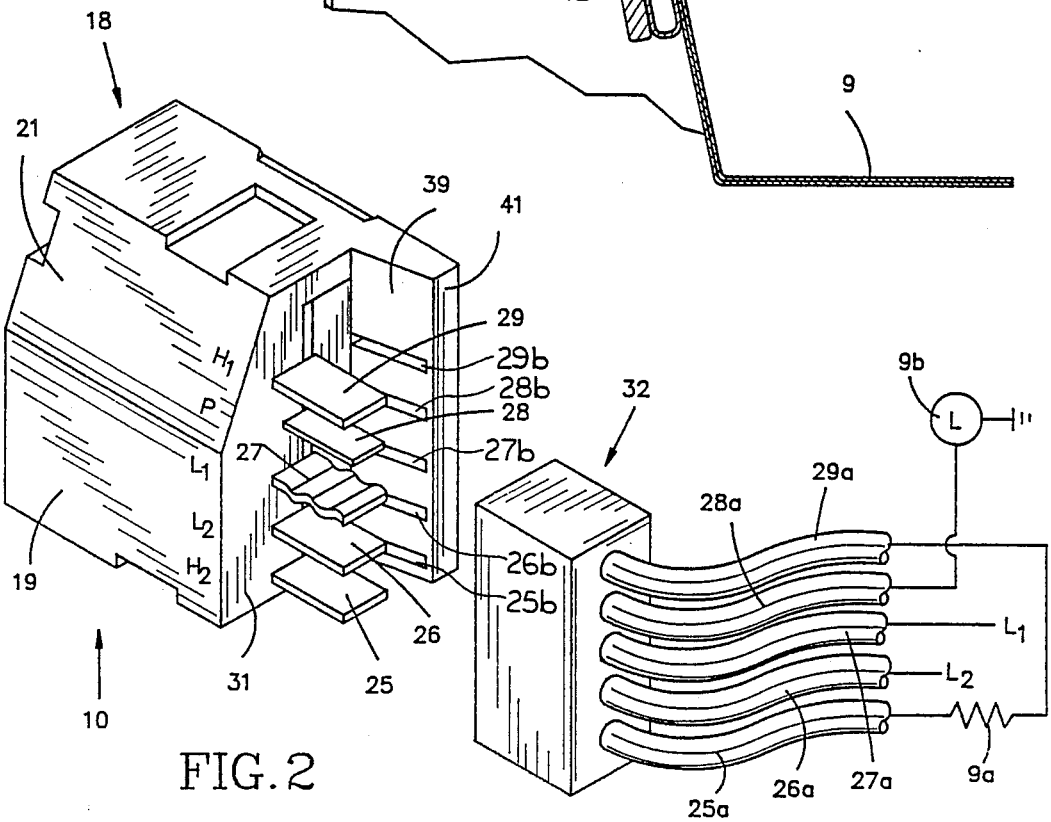
FIG. 2 is a perspective view illustrating the location of the terminals on the switch housing and a unitary connector for connecting each of the terminals to the electrical circuit in the cooking range.

The control switch 10 is provided with five terminals 25 through 29 which project from a side face 31 of the housing 18, as best illustrated in FIG. 2. These terminals provide the connections between the control switch 10 and the related circuit of the domestic range. The terminals 25 through 29 are arranged in the straight line in which the terminals extend parallel to each other. Consequently, a single unitary multiconductor connector 32 is used to simultaneously connect all of the terminals 25 through 29 to the range circuit. The multiconductor connector 32 provides conductors 25*a* through 29*a* which respectively connect with the terminals 25 through 29 when the connector is installed.

As indicated in FIG. 2, in a typical installation the conductors 26*a* and 27*a* are connected to the power source. The conductors 25*a* and 29*a* connect to the two ends of a surface heater unit 9*a* and the conductor 28*a* connects to one side of an indicator light 9*b*. The other side of the light 9*b* is grounded.

In the illustrated embodiment, the terminal 28 is narrower than the other terminals, so that the connector 32 can only be connected in one position in which the conductors correctly connect the terminals. If an attempt is made to install the connector 32 in the reverse orientation, the terminals will not fit into the connector. Incorrect installation of the connector is therefore avoided.

Further, the terminal 27 is formed with a shallow ripple or wavelike shape so as to ensure a snug fit between the terminal 27 and the associated socket within the connector 32. This ensures that the connector will remain in its connected position and will not vibrate or otherwise come loose.

Because all of the connections can be made with the switch in a simultaneous manner, the switch is highly adapted for automated assembly and, even when manually assembled or disconnected, reduces the labor required for the operation.

Figure 3A:
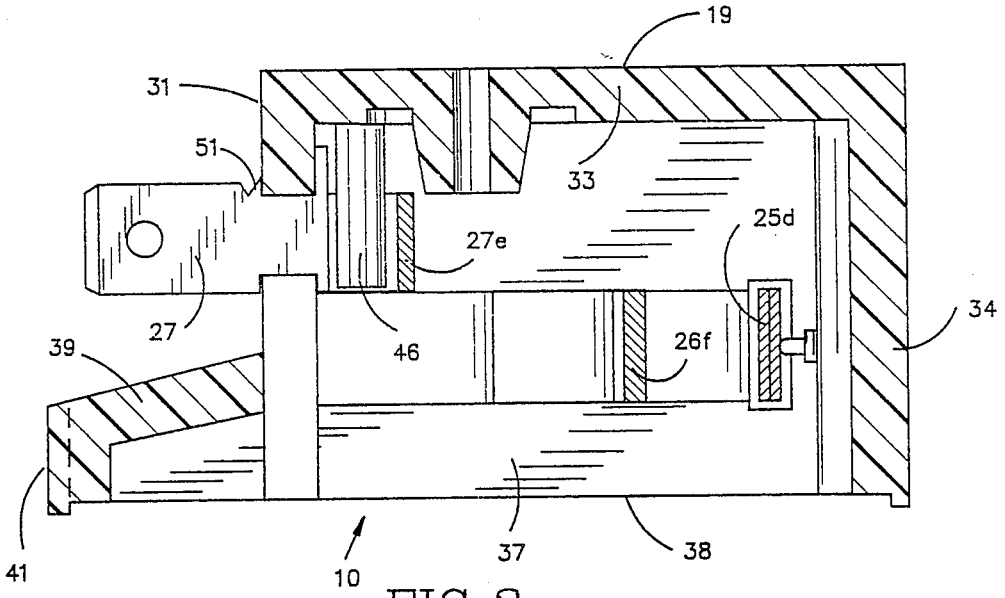
FIG. 3*a* is a cross section taken generally along line 3*a*—3*a* of FIG. 3 illustrating the staking of the terminals prior to the installation of the locking bar.
Figure 3:
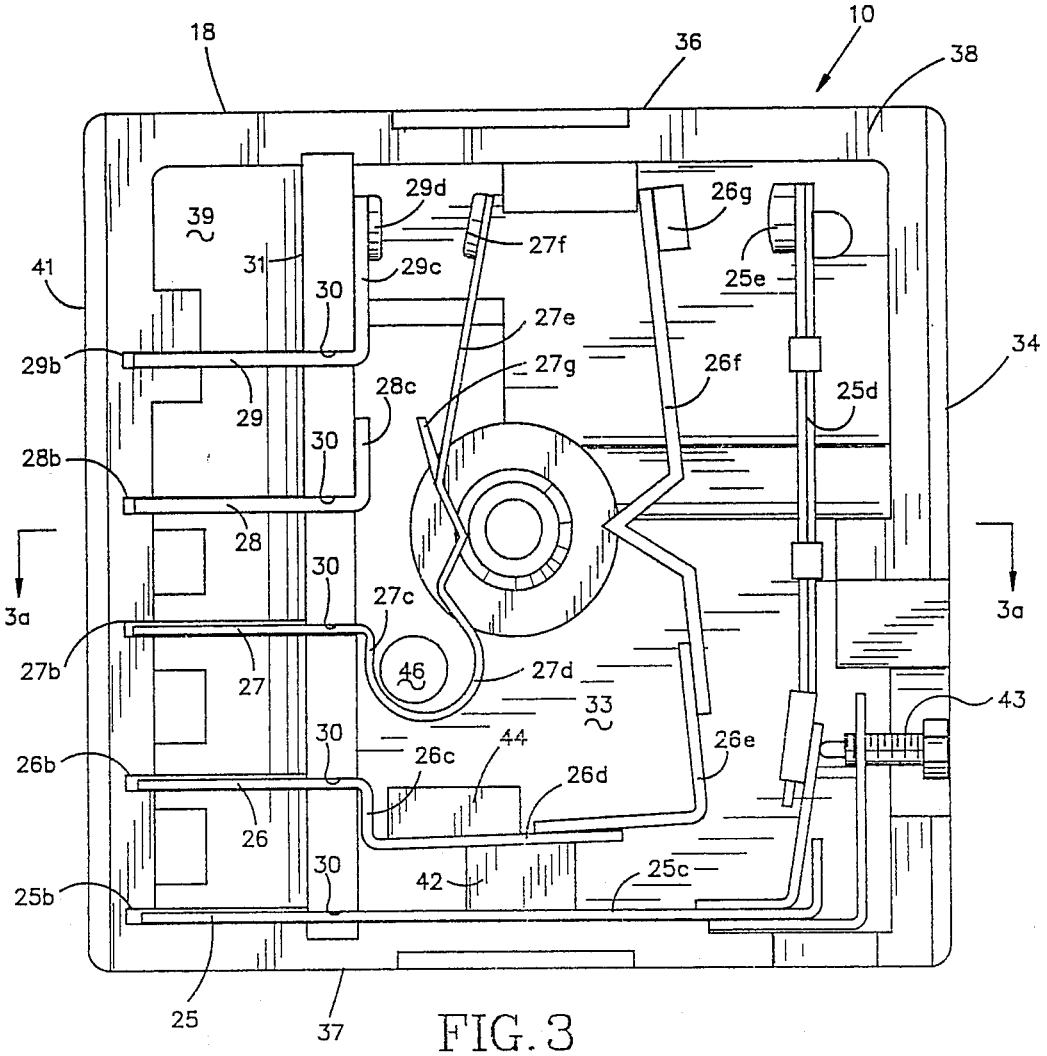
FIG. 3 is a plan view of a partially assembled switch illustrating the general switch layout.

FIGS. 3 through 5*a* progressively illustrate the assembly of the control switch 10. Referring to FIGS. 3 and 3*a*, the switch housing 18 is generally rectangular and is preferably molded of an insulating material such as phenolic resin. The housing provides a rearward or end wall 33 which provides the rearward surface portion 19 and the inclined wall portion 21, illustrated in FIGS. 1 and 2. The housing also provides the side face or planar wall portion 31 through which the terminals 25 through 29 extend and an opposite side wall 34. In addition, the housing provides a top and bottom side wall 36 and 37, respectively.

The side wall 34 and the top and bottom side walls 36 and 37, respectively, extend to a forward face 38 of the housing. The side wall 31, however, extends forwardly from the rearward face 33 only a portion of the way to the forward face 38. The side wall provides grooves 30 through which the terminals extend.

Forwardly of the side wall 31 is an inclined, laterally extending wall portion 39 extending from the side wall 31 to a forward wall portion 41. The inclined wall portion 39 and the forward wall portion 41 are provided with lateral openings 25*b* through 29*b* extending from the side wall 31 to a location adjacent to the lateral surface of the forward wall portion 41. These lateral openings have a lateral length sufficient to permit the terminals 25 through 29 to be installed within the housing 10 by straight-in movement from the forward face 38. Consequently, it is not necessary to provide movement of the terminals in the direction of their length during the installation thereof into the installed position in which they extend through the side wall 31.

In the illustrated embodiment, the terminal 25 is provided with extension 25*c* which extends along the inner surface of the bottom wall 37 to a location substantially adjacent to the side wall 34. Mounted on such extension is a bimetal contact arm 25*d* supporting a contact 25*e* at its free ends. The extension 25*c* is maintained against the inner surface of the bottom wall 34 by a projection 42 formed in the housing and extending forwardly from the rearward wall 33 thereof. Further, a calibration screw 43 is provided to calibrate the operation of the switch.

The terminal 26 is provided with an offset portion 26*c* extending along the inner surface of the side wall 31 and a lateral extension 26*d* positioned between the projections 42 and a projection 44. Mounted on the extension 26*d* is a spring element 26*e*, which resiliently supports a cantilever arm 26*f* having a contact 26*g* at its free end. The contact 26*g* and the contact 25*e* are movable from spaced positions in which they are electrically isolated from each other into contact with each other when the switch is closed, as discussed below.

The terminal 27 is provided with a lateral portion 27*c* extending along the inner surface of the side wall 31 and blending into a reverse curve 27*d* extending around a cylindrical projection 46. A cantilever arm portion 27*e* extends from the reverse bend 27*d* and supports a contact 27*f* at its outer end.

The terminal 28 is provided with an offset portion 28*c* extending along the inner surface of the wall 31. When the cantilever arm 27*e* is moved to the left, as viewed in FIG. 3, by an operating cam (illustrated in subsequent figures and discussed below), a small projection 27*g* engages the offset portion 28*c* and electrically connects the two terminals 27 and 28.

The terminal 29 is also provided with an offset portion 29*c* extending along the wall surface of the wall 31 and supporting at its end a contact 29*d*. As discussed below, when the contact 27*f* engages the contact 29*d*, a circuit is provided between the two terminals 27 and 29.

The control switch 10 provides three separate switches. The first switch interconnects the terminals 25 and 26 when closed. The second switch connects the terminals 27 and 28 when closed, and the third switch connects the terminals 27 and 29 when closed.

This switch arrangement is functionally identical to the switch arrangement disclosed in U.S. Letters Pat. No. 4,471,338 referred to above and incorporated herein by reference. Normally, the terminal 25 is connected to one end of the associated cooking element or heater 9*a*, and the terminal 26 is connected to one of the power lines. Therefore, when the switch provided by the two contacts 25*e* and 26*g* is open, one end of the associated heater is isolated from the power.

The terminal 27 is connected to the other power line and the terminal 29 is connected to the other side of the cooking element or heater 9*a*. Therefore, when the switches are in the open position, both ends of the heater are isolated from line power.

The terminal 28 is usually connected to a pilot or indicator light which indicates that the associated heating unit is energized. Since the power consumption for such indicator light is very low, contacts are not provided in this switch.

As the first step of the assembly of the total control switch, the various terminals and the switch components are installed in the housing 18 by straight-in insertion into the associated mounting grooves 30 provided in the side wall 31 in alignment with the lateral grooves 26*b* through 29*b*. As the terminals are moved to their installed position, they first pass through the lateral groove and then into the associated mounting grooves 30. Such movement does not require any movement of the terminals in the direction of their length. Therefore, the terminals can be formed with notches which embrace the adjacent side wall beyond the rearward end of the grooves 30 and which lock the terminals in position. This installation, which is straight-in movement of each of the terminals and switch components into the housing, is preferably automated to reduce manufacturing costs.

Figure 4A:
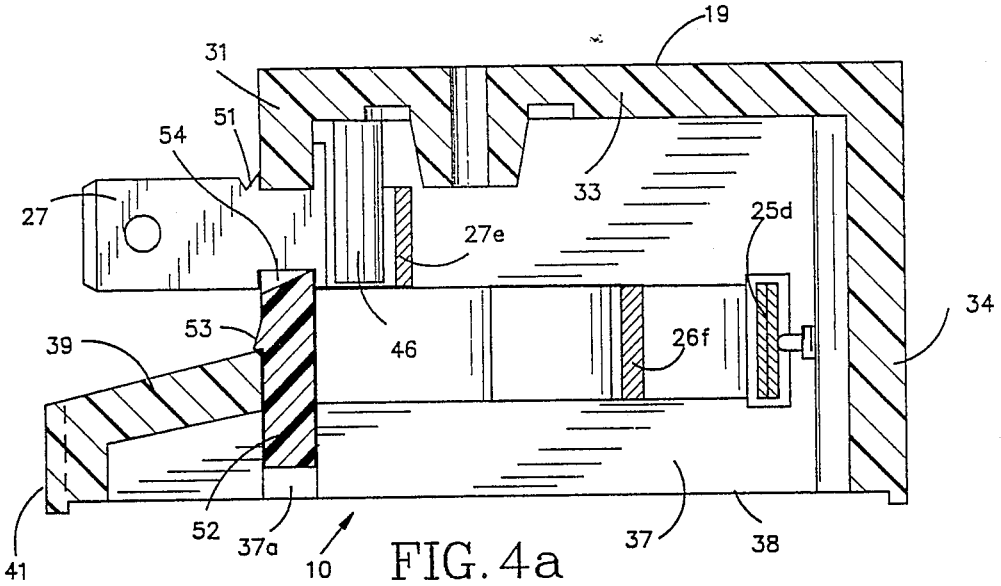
FIG. 4*a* is a cross section taken generally along line 4*a*—4*a* of FIG. 4 illustrating the mounting of the locking bar which completes the mounting of the terminals and in turn completes the mounting of the switch components.
Figure 4:
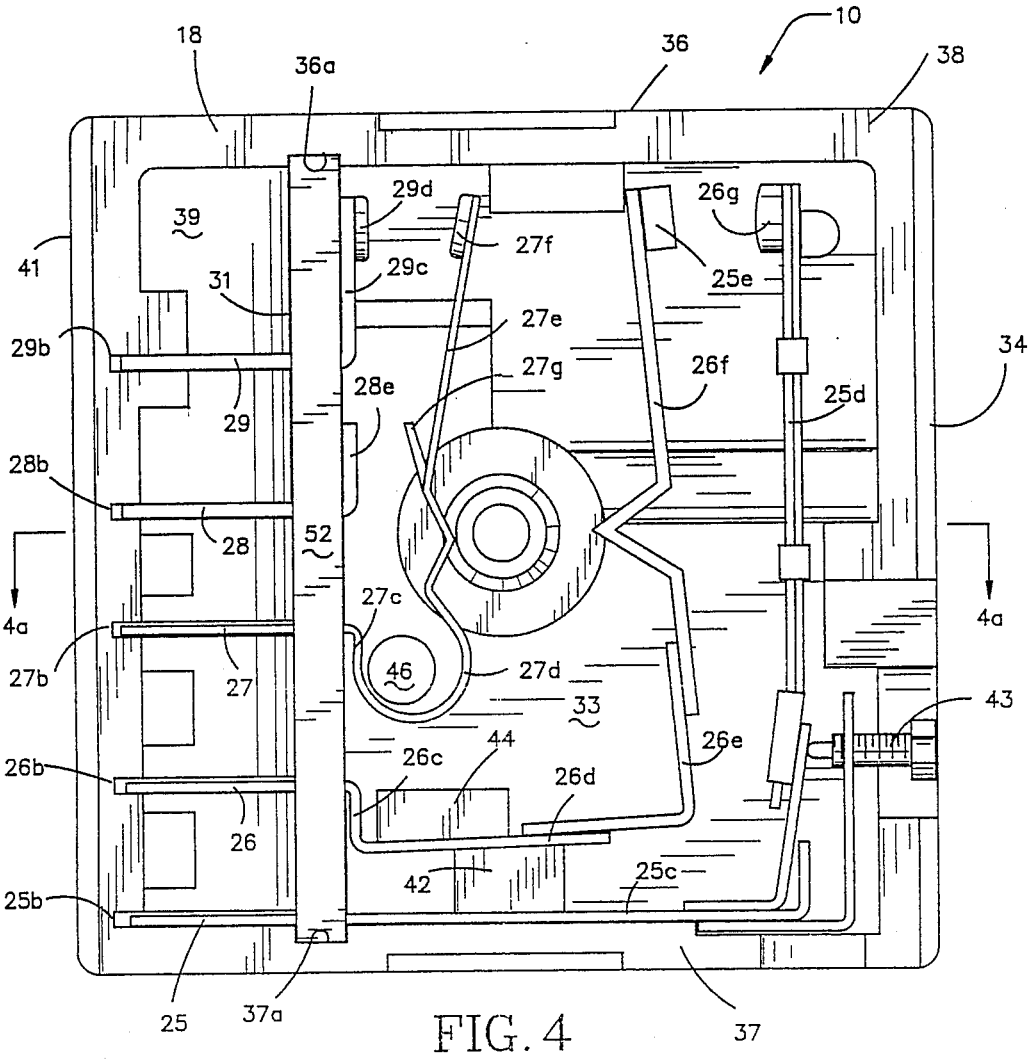
FIG. 4 is a plan view similar to FIG. 3, but illustrating the locking bar in the installed position.

Once the terminals are positioned as illustrated in FIG. 3 and 3*a*, one side of the terminal is staked at 51 so that the terminal tightly engages the inner and outer surfaces of the side wall 31 and is held against any lateral movement with respect thereto. It should be noted that after the first stage of assembly, however, the terminals are not positively held in the mounting grooves 30 and could move back up out of the housing. To prevent such movement, a locking bar 52 is installed in the housing, as illustrated in FIGS. 4 and 4*a*. This locking bar extends between the two side walls 36 and 37 and is positioned at its ends in mating grooves 36*a* and 37*a* formed in such side walls. In addition, the locking bar 52 extends past the inner ends of the lateral wall portion 39 and is provided with detent projections 53 which snap laterally behind the adjacent lateral wall portion 39 to secure the locking bar in position. A locking bar is also provided with a wedge-shaped end 54 which extends into a notch 56 formed in each of the terminals 25 through 29.

Preferably, the elements are sized so that when the locking bar 52 is installed, the forward edge of the end 54 is crushed a small amount by its engagement with the associated terminals. Such a structure ensures that the terminals are tightly engaged and overcomes any possibility of looseness created by manufacturing tolerances. Preferably, the locking bar is permanently mounted by an adhesive; however, the detent projections 53 ensure that the locking bar is held in its mounted position during the curing of the adhesive.

Once the locking bar 52 is installed, each of the terminals 25 through 29 is permanently mounted in the housing and is held against any movement relative to the housing created by externally applied forces. For example, the inner side of the locking bar and the inner side of the side walls 31 engage mating surfaces on the terminal to prevent outward movement of the terminal beyond the mounted position illustrated. Similarly, the stake 51 prevents inward movement of the terminal. Preferably, engagement between the staked portion 51 and the outer surface of the side wall 31 is located between the inner and outer extremities of the terminal portion engaging the inner surfaces of the side wall 31 so that tipping movement is also prevented.

Figure 5A:
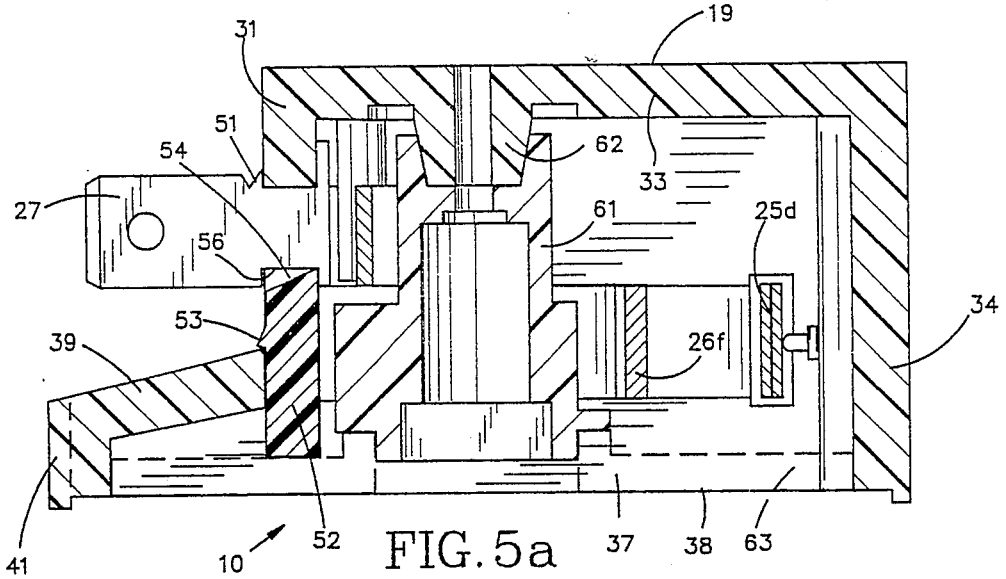
FIG. 5*a* is a cross section taken generally along line 5*a*—5*a* of FIG. 5.
Figure 5:
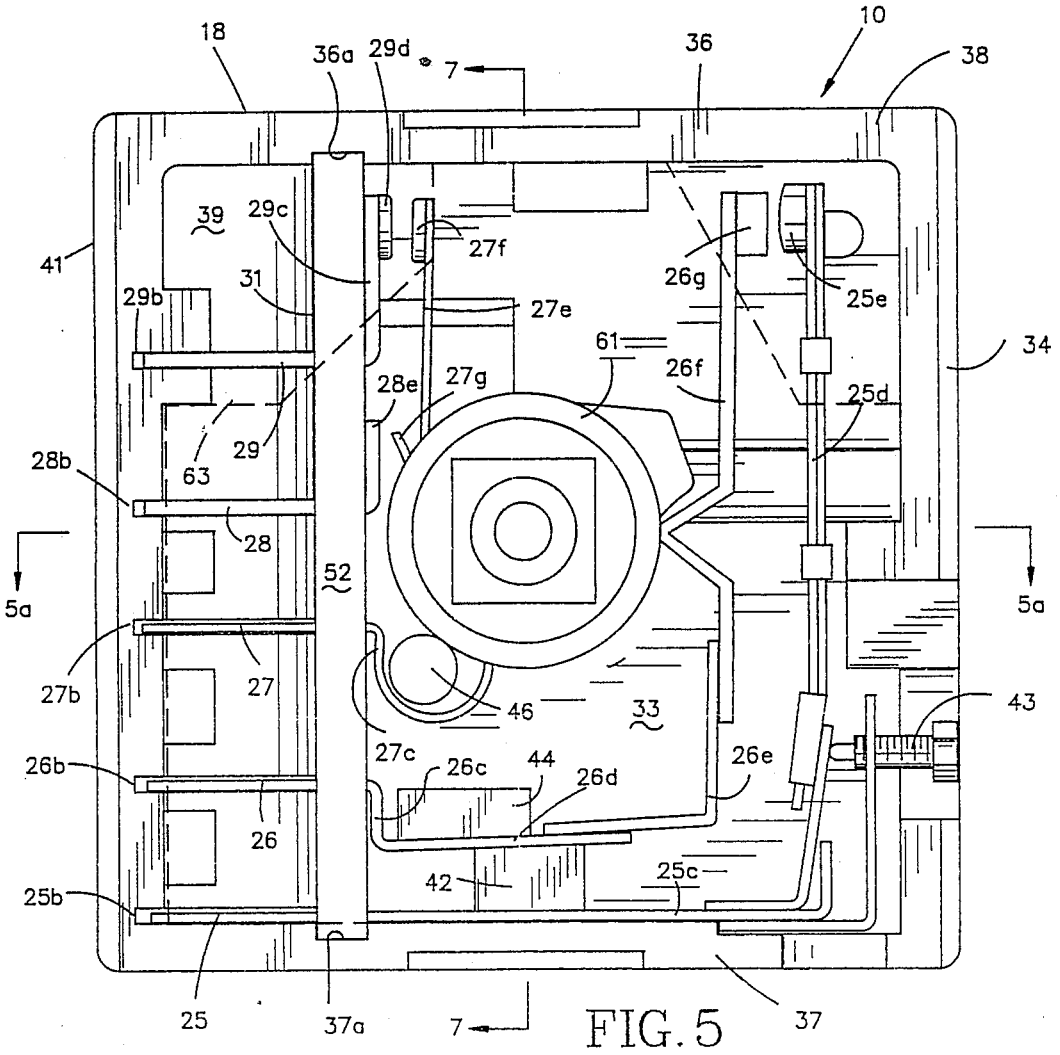
FIG. 5 is a plan view similar to FIGS. 3 and 4 after the cam is installed and illustrating in phantom the cam guide.
Figure 6:
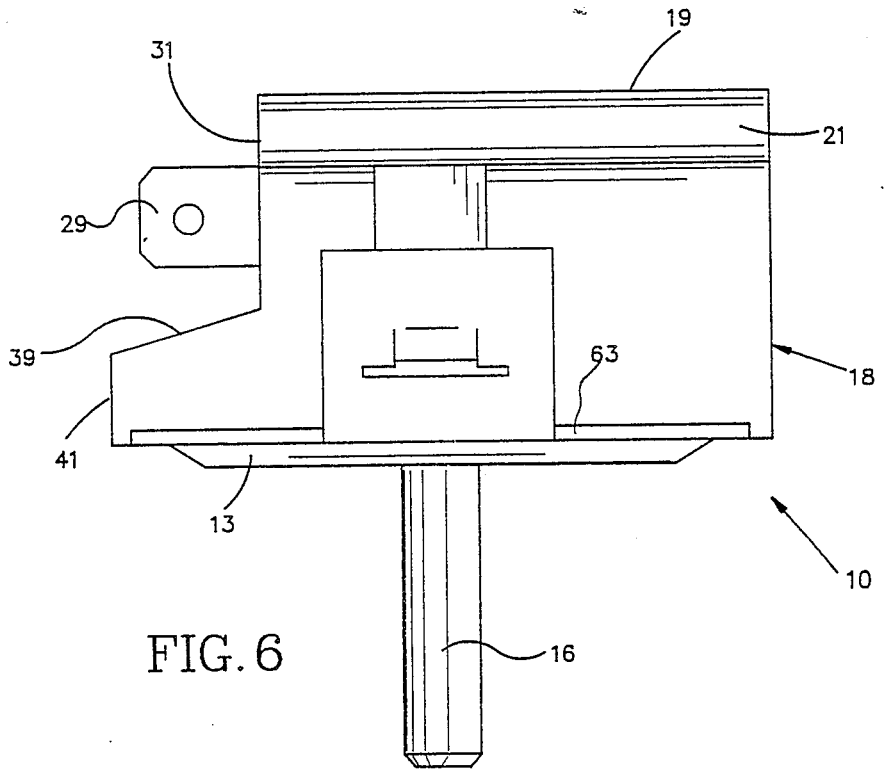
FIG. 6 is a side elevation of a fully assembled switch.

After the locking bar 52 is installed, an operating cam 61, illustrated in FIGS. 5 and 5*a*, is installed and is guided at its inner ends by a projection 62, as discussed and claimed in the aforementioned U.S. Pat. No. 4,471,338. The cam 61 is shaped so that in the off position, all of the switches are opened, as illustrated in FIG. 5. However, rotation from the off position illustrated causes the cam to close all three switches. This energizes the heater and also operates the indicator light. After the cam 61 is installed, a cam guide plate 63 (illustrated in phantom) and a cover 13 are installed to complete the switch. Here again, the structure and function of the cam guide 63 are described in the aforementioned U.S. Pat. No. 4,471,338.

The bimetal contact arm 25*d* is connected in series with the heater and is, in turn, heated by the flow of electrical power through the heater. When the temperature of the bimetal contact arm 25 reaches a temperature determined by the position of the contact 26*g*, it moves the contact 25*e* away from the contact 26*g* and opens the circuit. Thereafter, as the bimetal contact arm 25*d* cools, it returns the switch to a switch-closed condition and the circuit is re-established. The period the switch is closed compared to the period the switch is open determines the heat output of the associated cooking element or heater 9*a* and is adjustable by rotating the cam 61 to reposition the contact 26*g* within the housing.

Figure 7:
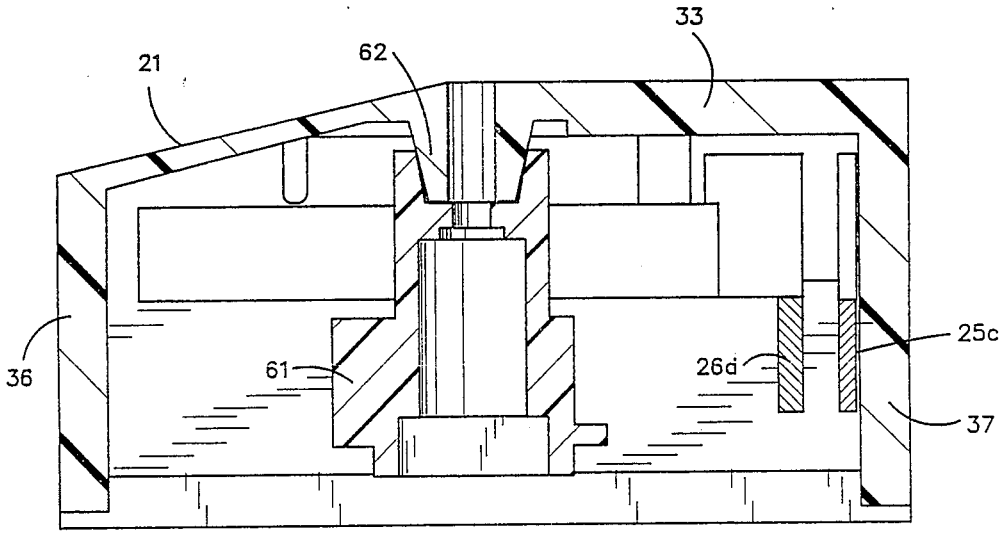
FIG. 7 is a cross section taken generally along line 7—7 of FIG. 5, with parts removed for purposes of illustration.

It should be understood that the basic switch structure and function are very similar to the switch structure and function illustrated in the aforementioned U.S. Letters Pat. No. 4,471,338; however, the illustrated embodiment of this invention provides a terminal arrangement facilitating simultaneous connection by a single multiconductor connector 32 illustrated in FIG. 2. Further, by providing the terminals in the side wall, the cavity in which the control switch is mounted need not be provided with increased depth to accommodate connectors and terminals on the rearward face of the control switch. Still further, the control switch is provided with an inclined rearward wall, as best illustrated in FIGS. 1 and 7, so that the switch can be mounted within a control panel having a decreasing switch cavity depth.

It is within the broader aspects of this invention, however, to construct the switch so that the terminals are mounted in a straight line along the rearward wall of the housing and support contact elements at various locations within the switch housing spaced from the mounting of the associated support terminals.

Figure 8A:
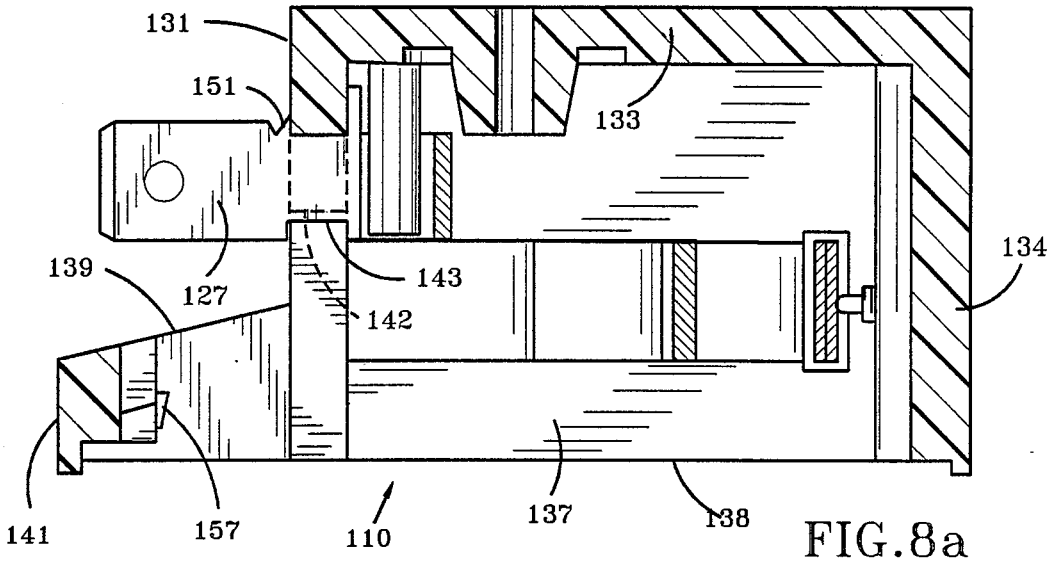
FIG. 8*a* is a cross section taken generally along line 8*a*—8*a* of FIG. 8.
Figure 8:
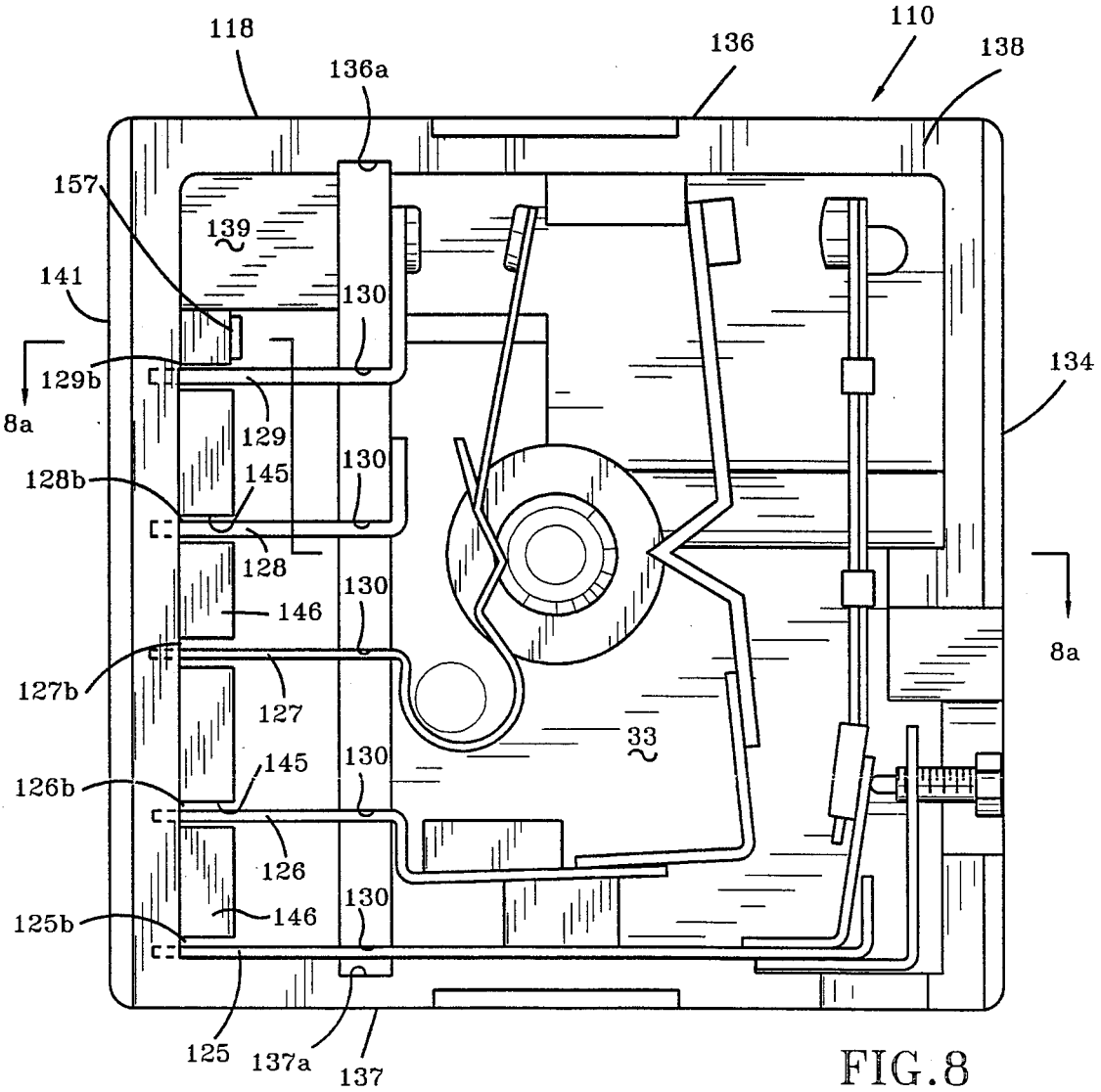
FIG. 8 is a plan view of another embodiment of the invention showing the switch partially assembled prior to assembly of the locking bar.
Figure 9A:
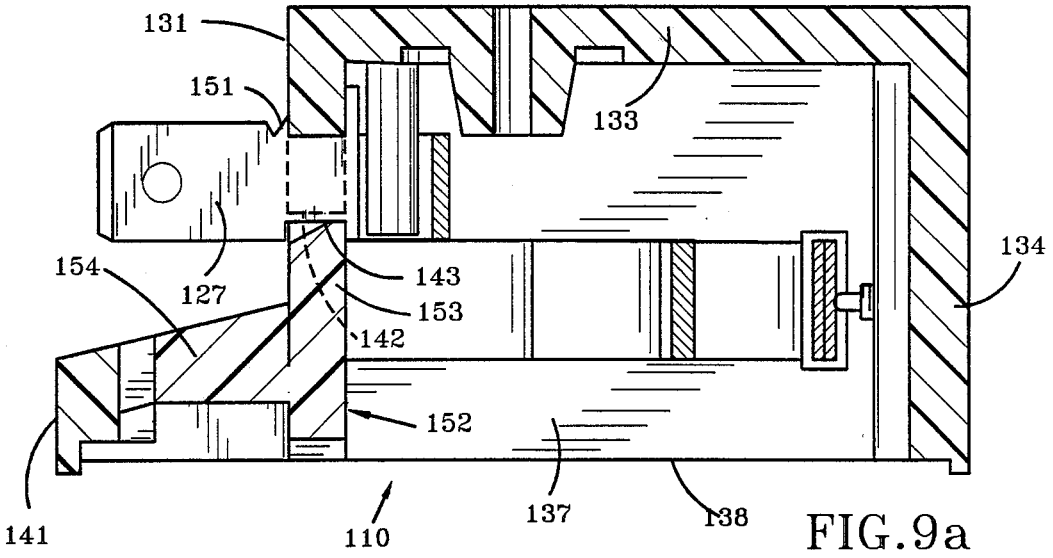
FIG. 9*a* is a cross section taken generally along line 9*a*—9*a* of FIG. 9.
Figure 9:
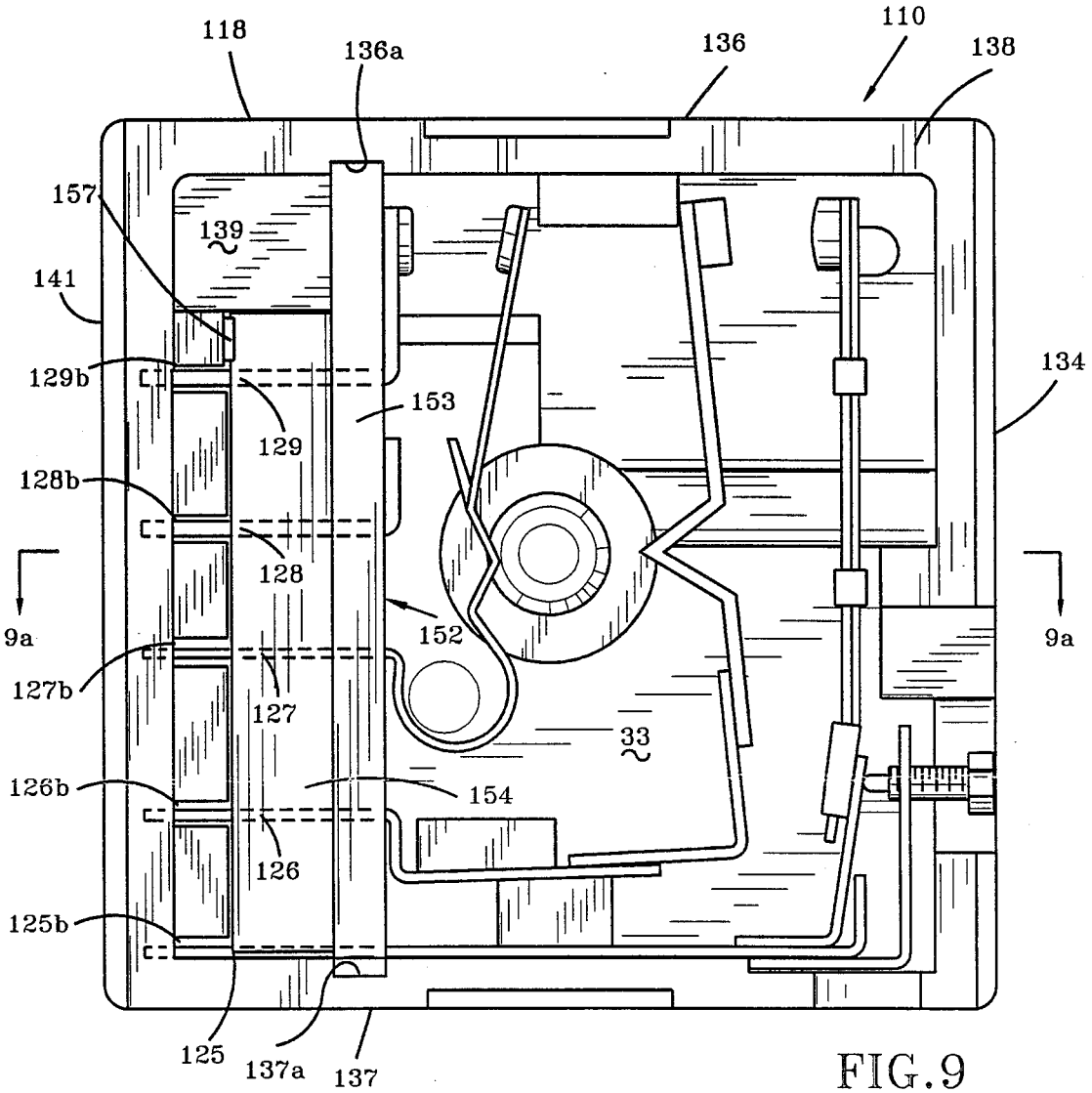
FIG. 9 is a plan view similar to FIG. 8, but illustrating the locking bar in the installed position.

Another embodiment of the invention is shown in FIGS. 8 and 9 which are similar to FIGS. 3 and 4 of the first embodiment. This second embodiment differs in the area of the terminal mounting slots and the locking bar. Since the thermal cycling contacts and other electrical mechanism within the housing are the same as in the first embodiment, their discussion will not be repeated and it may be assumed that any component in the second embodiment is the same as the corresponding one in the first embodiment except as described hereinafter.

The control switch 110 has a housing 118 formed of a suitable insulating material, such as phenolic resin, and has a boxlike shape defined by the rearward wall 133 and side walls 131, 134, 136, and 137. The side walls 134, 136, and 137 define a forward, open face 138 which is completed by the fourth wall 141 which extends upward from a lateral inclined wall 139 connected on its other side to the side wall 131. Thus, side wall 131 extends only a portion of the distance forward from the rearward wall 133, and serves to mount the terminals 125–129, which are fitted within mounting grooves 130 formed on side wall 131. The mounting grooves 130 have a depth such that when the terminals 125–129 are fully inserted, the notch 143 formed on each of the terminals in lateral alignment with wall 131 extends only a short distance above the outer edge 142 of wall 131 for proper gripping of the terminals, as described hereinafter.

Just as wall 131 terminates in a top edge 142, which is, in effect, of a castellated-type construction as a result of the mounting grooves 130, likewise the lateral wall 139 extends only a short distance from the forward wall 141, where it is formed into a plurality of projections 146 spaced by clearance grooves 145, which are in alignment with the mounting grooves 130 to allow assembly of the terminals within the housing. With this arrangement, the clearance grooves 145 are not sufficiently deep to allow the terminals 125–129 to be inserted axially into the housing, but they must be inserted at an angle. However, the shallowness of the clearance grooves 145 provides the forward wall 141 with increased thickness at all points so that it is sufficiently strong and rigid to avoid the danger of breakage at the thin points at the clearance grooves 145.

The terminals 125 and 129, after insertion into the mounting grooves 130, are held in place while the staking operation is performed by deforming the terminals at the staking area indicated at 151, so that the terminals tightly grip the wall 131. The greater area provided by eliminating a substantial portion of the inclined lateral wall 139 allows the use of a larger support tool for holding the terminals in place during the staking operation, thereby ensuring that the staking can be done with greater precision.

The terminals are further held in place by a locking bar 152 which is positioned at each end in the 4 grooves 136*a* formed in the side walls 136 and 137 in alignment with the side wall 131. Thus, the locking bar 152 comprises both a side wall portion 153 forming an extension of the side wall 131, as well as a lateral wall portion 154, which fills the cutaway portion of and serves as an extension of the lateral wall 139. The side wall portion 153 fits within the notches 143 on the terminals to tightly clamp the terminals in place. In order to retain the locking bar 152 in place during assembly operations, one or more detent projections 157 may be formed on the ends of the projections 146 to engage the edge of the lateral wall portion 154. However, it is contemplated that once the locking bar is pressed into place, a suitable cement will thereafter be applied to the joints between the locking bar and the rest of the housing 118 to positively hold the locking bar in place.

With this second embodiment of the invention, the front wall 141 is made more rigid, while the removal of the portion of the inclined lateral wall 139 and its substitute in the lateral wall portion 154 of locking bar 152 provides greater area for holding the terminals prior to assembly of the locking bar, and the locking bar itself is substantially more rigid as a result of the presence of the two wall portions 153 and 154.

Although the preferred embodiments of this invention have been shown and described, it should be understood that various modifications and rearrangements of the parts may be resorted to without departing from the scope of the invention as disclosed and claimed herein.

What is claimed is:

1. A control switch terminal assembly comprising a housing having a back wall and a front face, said housing providing a side wall portion extending from said back wall toward said front face and terminating at a location spaced from said front face: an inclined lateral wall extending from said side wall portion to said front face at a location laterally spaced from said side wall portion, said side wall portion providing grooves therein open along the forward side thereof, said lateral wall providing openings therein aligned with said grooves and extending from said side wall portion to opening ends spaced from the lateral extremity of said lateral wall, and terminals mounted in said grooves installed therein by movement through said openings.

2. A control switch as set forth in claim 1, wherein a locking bar is secured at each end in said housing in engagement with said terminals to retain them in said grooves.

3. A control switch as set forth in claim 2, wherein said locking bar serves as an extension of said side wall.

4. A control switch as set forth in claim 3, wherein said locking bar serves as an extension of said lateral wall.

5. A thermal cycling switch having a housing of insulating material having an end wall, a plurality of side walls extending from said end wall and defining a face, at least one of said side walls being planar and terminating in an edge a spaced distance from said face, a cover extending over said face and secured to said housing, said housing and said cover defining a cavity, a rotatable operating cam mounted centrally in said housing, first and second switches in said cavity, said first switch being positioned between said cam and said planar side wall, said second switch being positioned between said cam and the side wall opposite said planar side wall, said planar wall having a plurality of slots extending from said edge toward said end wall, each of said switches including at least two terminals with each terminal extending through one of said slots from said cavity to the exterior of said housing, each of said terminals being staked to said planar wall to hold said terminal and the connected portion of the switch in position in said cavity, and a locking bar secured in said housing generally in alignment with said planar wall and extending between said edge and said face to clamp said terminals in said slots.

6. A thermal cycling switch as set forth in claim 5, wherein said housing includes an inclined lateral wall portion extending from said planar wall over said terminals.

7. A thermal cycling switch as set forth in claim 6, wherein said lateral wall is spaced from said planar wall by said locking bar.

8. A thermal cycling switch as set forth in claim 7, wherein said locking bar provides portions of said lateral wall and said planar wall and defines the intersection of said walls.

9. A thermal cycling switch as set forth in claim 5, wherein said housing side walls define grooves parallel to said planar wall and said locking bar engages said grooves.

* * * * *